United States Patent [19]

Nishimura et al.

[11] 3,958,057

[45] May 18, 1976

[54] LEATHER-LIKE SHEET MATERIAL HAVING EXCELLENT PEARL-LIKE TINT AND PROCESS FOR PREPARATION THEREOF

[75] Inventors: Takeo Nishimura; Kazundo Akamata, both of Okayama, Japan

[73] Assignee: Kuraray Co., Ltd., Kurashiki, Japan

[22] Filed: June 24, 1975

[21] Appl. No.: 589,806

[30] Foreign Application Priority Data

| | | |
|---|---|---|
| June 28, 1974 | Japan | 49-74173 |
| June 28, 1974 | Japan | 49-74174 |
| June 29, 1974 | Japan | 49-74628 |
| Oct. 8, 1974 | Japan | 49-115893 |

[52] U.S. Cl. ..... 428/216; 427/202; 427/203; 427/412; 428/286; 428/324; 428/336; 428/425; 428/904

[51] Int. Cl.[2] ..... B32B 19/02; B32B 27/40

[58] Field of Search ..... 428/216, 324, 336, 286, 428/904, 425

[56] References Cited

UNITED STATES PATENTS

| | | | |
|---|---|---|---|
| 3,185,582 | 5/1965 | Alegre | 428/904 X |
| 3,235,399 | 2/1966 | Martin | 428/286 |
| 3,400,036 | 9/1968 | Hemrick et al. | 428/336 X |
| 3,481,663 | 12/1969 | Greenstein | 428/324 X |
| 3,619,244 | 11/1971 | Stanley et al. | 428/336 X |
| 3,650,880 | 3/1972 | Tieniber | 428/336 X |
| 3,908,060 | 9/1975 | Okazaki et al. | 428/904 X |

*Primary Examiner*—Harris A. Pitlick
*Attorney, Agent, or Firm*—Kaufman & Kramer

[57] ABSTRACT

A leather-like sheet material is provided having a good pearl-like tint, said sheet material comprising a substrate comprising a fibrous mat and a porous coating layer of a polymer composed mainly of a polyurethane elastomer, a pearl layer having a thickness of 0.2 to 10$\mu$ and comprising a polymer composed mainly of a polyurethane elastomer and 3 to 500% by weight, based on the polymer, of a pearl pigment, and a colored layer having a thickness of 0.1 to 10$\mu$ and comprising a polymer composed mainly of a polyurethane elastomer and 1 to 300% by weight, based on the polymer, of a dyestuff and/or 1 to 600% by weight, based on the polymer, of a pigment.

12 Claims, No Drawings

LEATHER-LIKE SHEET MATERIAL HAVING EXCELLENT PEARL-LIKE TINT AND PROCESS FOR PREPARATION THEREOF

This invention relates to a novel leather-like sheet material having an excellent pearl-like tint and a process for the preparation thereof. More particularly, the invention relates to a process for preparing a novel leather-like sheet material having an excellent pearl-like tint from a porous sheet material comprising a fibrous mat and a coating layer composed mainly of a polyurethane elastomer, and to an improvement of this process.

It is known that leather-like sheet materials can be obtained by coating a polymer composed mainly of a polyurethane elastomer on a fibrous mat and subjecting the coated fibrous mat to such finishing treatments as crumpling, dyeing and embossing treatments.

It is also known that leather-like sheet materials having a glistening pearl-like tint can be obtained by coloring the above leather-like sheet materials with a dye or pigment giving a pearl-like tint. As the ordinary method for coloring these sheet materials, there are known a surface-dyeing method, a paint ink-coating method, a total surface dip dyeing method and a coating method using a dispersion of a dyestuff or pigment in a polymer solution. All of these conventional coloring methods however, are unsatisfactory with respect to the clearness of color.

More specifically, according to the conventional techniques, for production of leather-like sheet materials having an excellent pearl-like tint, there is mainly adopted a method in which a dispersion of a suitable pearl pigment in a polymer solution is merely coated on a leather-like sheet material, and in case it is difficult to obtain a desired color only with the pearl pigment, another dyestuff or pigment of a suitble color is further added to said polymer solution.

According to this conventional coloring method, in the case of a lightly colored product in which the dye used has a light color and the amount of the dye added is relatively small, it is possible to obtain a desired color of a high clearness while keeping a good pearl-like tint. However, if the color of the dye used is dense or the amount of the dye added is large, namely in the case of a medium colored product or densely colored product, the clearness of the color is readily damaged and a desired color tone can hardly be obtained. In a porous sheet material having a pearl-like surface, it is most important that the color should be clear.

It is therefore a primary object of this invention to provide a leather-like sheet material having a clear pearl-like tint. Another object of this invention is to provide an industrial process for the production of leather-like sheet materials which have a clear pearl-like tint and in which manifestation of a desired color, namely so-called color matching, can be accomplished very easily.

It has now been found that the pearl-like tint of a porous sheet material is greatly influenced by the structure of the material and the production process, especially the color matching method. It has also been found that when (A) a pearl layer comprising a polymer composed mainly of a polyurethane elastomer and a pearl pigment and (B) a colored layer comprising an other dye and/or pigment and a polymer composed mainly of a polyurethane elastomer are overlayed in layers, clear pearl-like tint can be obtained. It has further been found that when the sequence of layering of the above two layers (A) and (B) is appropriately adjusted, a leather-like sheet material excellent in the pearl-like tint, in which color matching can be performed very easily, can be provided. This fact is peculiarly observed only when a pearl pigment is employed, and this is a surprising finding not expected from the conventional techniques.

In this invention, a sheet-like material comprising a fibrous mat and a porous coating comprising a polymer composed mainly of a polyurethane elastomer is used as a substrate. Materials generally used as foundation materials for production of artificial leathers can be used as such substrate in this invention, and they are generally prepared by coating a solution of a polymer composed mainly of a polyurethane elastomer on a fibrous mat composed of staple fibers or long filaments and coagulating the coated fibrous mat according to the wet method. In this invention, a fibrous mat impregnated with a polymer composed mainly of a polyurethane elastomer can be preferably used. These foundation materials for artificial leathers are disclosed in, for example, the specifications of U.S. Pat. No. 3,100,721, U.S. Pat. No. 3,424,604 and U.S. Pat. No. 3,706,613, the disclosure of which is incorporated herein by reference.

Foundation materials prepared by a method other than the above-mentioned method can also be used as the substrate in this invention. For example, foundation materials formed by laminating a porous film of a polymer composed mainly of a polyurethane elastomer on a fibrous mat can be used as the substrate in this invention.

The thickness or apparent density of the substrate is changed depending on the intended use of the product, but it is generally preferred that the thickness of the substrate be 0.3 to 5mm and the apparent density of the substrate be 0.25 to 0.90 g/cc.

The pearl layer (A) of this invention comprises a pearl pigment and a polymer composed mainly of a polyurethane elastomer. It is critical that the pearl layer should have a thickness of 0.2 to 10$\mu$, preferably 0.4 to 5$\mu$, as measured as the solid and the pearl layer should contain the pearl pigment in an amount of 3 to 500% by weight, preferably 10 to 200% by weight, and most preferably 50 to 100% by weight, based on the polymer. When the thickness of the pearl layer is smaller than 0.2$\mu$, no good pearl-like tint is obtained, and if the thickness of the pearl layer is larger than 10$\mu$, the flexural fatique strength and the surface bending crimp as a leather substitute are degraded. If the pearl pigment content is lower than 3% by weight based on the polymer, no good pearl-like tint is obtained and the commercial value is lowered. When the pigment content is higher than 500% by weight based on the polymer, the stability of the polymer solution is degraded, uneven coating is caused, the adhesion characteristic or flexural fatique resistance is degraded, and the surface bending crimp as a leather substitute is also degraded. A small amount of a dyestuff can be incorporated in the pearl layer, so long as the incorporation does not damage the pearl-like tint. It is considered desirable that weight, amount of the dyestuff be smaller than 100% by weight, generally smaller than 500% by weight based on the polymer. If the amount of the dyestuff incorporated exceeds 100% by weight based on the polymer, the pearl-like tint is drastically degraded.

As employed herein, the term "pearl pigment" refers to a glistening powdery pigment. As such pearl pigments, there can be mentioned, for example, a pigment formed by coating mica with titanium oxide, powders of such metals as aluminum, zinc, copper and copper alloys, and pigments formed by coating these metal powders with a pigmented synthetic resin. Among these pearl pigments, a pearl pigment of a particle size of 1 to 70$\mu$ formed by coating mica with titanium oxide is especially preferred, because the color can be changed significantly by changing the thickness of the titanium oxide coating layer. use of a pearl pigment having a particle size of 5 to 30$\mu$ and being formed by coating mica having a specific gravity of 2 to 4, especially 2.5 to 3.5, with titanium oxide is particularly preferred in this invention, because this pigment has good dispersion stability in a polyurethane solution and gives a clear pearl-like tint. As such preferred pearl pigment, there can be mentioned Iriodin Ti 100 and Tridin Color Ti 100, each of which is a product of Merck and Co.

The colored layer (B) of this invention comprises a pigment and/or dyestuff and a polymer composed mainly of a polyurethane elastomer. The thickness of the colored layer is 0.1 to 10$\mu$, and the amount of the dyestuff is 1 to 300% by weight, preferably 20 to 150% by weight, based on the polymer and the amount of the pigment is 1 to 600% by weight, preferably 5 to 500% by based based on the polymer. When the thickness of the colored layer is less than 0.1$\mu$, an unsatisfactory tinting effect is obtained even if the amount of the pigment or dyestuff incorporated is increased. When the thickness of the colored layer is greater than 10$\mu$, the flexural fatique strength or bending crimp of the porous sheet material is degraded and no good leather-like sheet material can be obtained. If the amount of the pigment or dye incorporated is too small, an unsatisfactory tinting effect is obtained, and if the amount of the pigment or dyestuff incorporated into the colored layer is too large, the flexural fatique strength of the porous sheet material is degraded and the method for formation of the colored layer becomes difficult. Any of ordinary inorganic pigments and organic pigments can be used for formation of the colored layer. The selection of the dyestuff to be incorporated into the colored layer is not particularly restricted but in view of the coloring property, the bleeding resistance and the light resistance, use of complex salt dyes is especially preferred. The color of the colored layer has a great influence on the color or pearl-like tint of the final product and therefore, the color is decided after giving due consideration to the kind of pearl pigment employed and the intended color of the product.

A novel leather-like sheet material of this invention having an excellent pearl-like tint can be obtained by overlying the pearl layer (A) and the colored layer (B) in layers on a substrate such as mentioned above. In this invention, a sheet material excellent in the pearl-like tint can be obtained by overlaying the colored layer (B) and the pearl layer (A) in order on the substrate. In general, however, a method comprising laying the pearl layer (A) on the substrate and then overlaying the colored layer (B) on said pearl layer (A) is especially preferred, because the resulting leather-like sheet material has a very clear tint. This preferred method is also advantgeous in that leather-like materials having an excellent pearl-like tint and differing in hue can easily be obtained by changing optionally the color of the colored layer (B). This advantage makes it possible to provide products at low costs even by small-quantity multi-variety manufacture, and hence, this preferred method is industrially very significant.

Further, in this latter method, it is preferred to use a dyestuff alone for formation of the colored layer without using a pigment in order to obtain a sheet-like material having a good pearl like tint. Moreover, in this method, the amount used of the dyestuff can be reduced as compared with the case where the colored layer is disposed below the pearl layer. For example, it is sufficient that the amount of the dye is smaller than 200% by weight, preferably 10 to 100% by weight, based on the polymer.

In this invention, in order to obtain an enameled porous sheet material, a clear layer of a thickness of 0.1 to 100$\mu$, preferably 0.4 to 40$\mu$, formed of a polymer composed mainly of a polyurethane elastomer may be further applied. In this case, if the thickness of the clear layer is smaller than 0.1$\mu$, insufficient gloss is obtained, and if the thickness of the clear layer is larger than 100$\mu$, the flexural fatique strength or the surface bending crimp of the porous sheet material is degraded. It is important that the polymer to be used for formation of this clear layer should have a high transparency. If the transparency of the polymer is low, the pearl-like tint is degraded. It is possible to incorporate into the clear layer a small amount of a dyestuff which does not damage the transparency, generally in an amount smaller than 20% by weight based on the polymer.

In case uneven coagulation is caused on the surface of the porous substrate or the ground color should be changed to obtain a desired final color, a hiding layer (D) comprising a polymer and a pigment can be disposed between the porous substrate and the pearl layer. It is critical that the hiding layer (D) should have a thickness of 0.1 to 10$\mu$ and should contain 1 to 600% by weight, based on the polymer, of a pigment. When the thickness of the hiding layer is smaller than 0.1$\mu$, color unevenness cannot be hidden whatever kind or amount of the pigment may be chosen, and when the thickness of the hiding layer is larger than 10$\mu$, the flexural fatique resistance or the surface bending crimp of the porous sheet material is degraded. When the amount of the pigment incorporated in the hiding layer is smaller than 1% by weight based on the polymer, no satisfactory hiding effect can be obtained, and if the amount of the pigment is larger than 600% by weight of the polymer, the flexural fatique strength of the porous sheet material is degraded and formation of the hiding layer becomes difficult. For formation of this hiding layer, a dyestuff can be used instead of the pigment, though the hiding effect is lowered to some extent.

The polymer composed mainly of a polyurethane elastomer, which constitutes the clear layer, pearl layer, colored layer and substrate of the porous sheet material of this invention, can be either a polyurethane elastomer alone or a mixture comprising more than 50% by weight of a polyurethane elastomer and less than 50% by weight of other polymer.

The polyurethane elastomer to be used in this invention is one synthesized from an ester type or ether type polymer glycol having a molecular weight of 500 to 4000, an organic diisocyanate and a chain extender having at least two active hydrogen atoms at the molecule ends. As the ester type or ether type polymer glycol, there can be mentioned, for example, polyethylene glycol, polypropylene glycol, polytetramethylene glycol, polyhexamethylene glycol, polycaprolactone glycol, polyethylene adipate glycol, polypropylene adipate glycol, polyethylenepropylene adipate glycol and the like. As the chain extender, there can be mentioned, for example, ethylene glycol, 1,4-butane diol, diethylene glycol, hydrazine and the like. As the diisocyanate, there can be mentioned, for example, diphenylmethane-4,4'-diisocyanate, tolylene diisocyanate, hexamethylene diisocyanate and the like.

As the polymer to be used in mixing with the polyurethane elastomer, there can be mentioned polymers having a compatibility with the polyurethane elastomer, such as polyvinyl chloride, polyvinyl formal, poly(methyl methacrylate), vinylidene chloride-acrylonitrile copolymers, vinyl chloride-vinyl acetate copolymers and the like. If such polymer is used in too large an amount, the touch or flexural fatique strength of the porous sheet material is degraded. Accordingly, the polymer is used in an amount of smaller than 50% by weight based on the total polymers.

When a dyestuff is used for formation of the colored layer, it is preferred that polyethylene glycol be used as the polymer glycol of the polyurethane elastomer.

From the industrial viewpoint, it is advantageous that the pearl layer, colored layer or hiding layer of the porous sheet material be formed by coating a polymer solution having a prescribed composition such as mentioned above by spraying or using a gravure roll and drying the coating. In view of the color uniformity obtained and the ease of operation, a coating method using a gravure roll is especially preferred. Better results are obtained by forcibly drying the polymer solution coating with dried air or hot air than by natural cooling.

An optional pattern can be formed on the porous sheet material by pressing or embossing during the preparing process.

As the solvent to be used for formation of a solution of a polymer composed mainly of a polyurethane elastomer, there can be mentioned, for example, dimethylformamide, dimethylacetamide, dimethylsulfoxide, dioxane, toluene, acetone, tetrahydrofuran, cyclohexanone and the like. A stabilizer, an antistatic agent, a plasticizer, an antioxidant, an ultraviolet absorber, a filler, a lubricant and other additives can be incorporated into this polymer solution according to need.

The leather-like porous sheet material of this invention includes not only a sheet material in which respective layers are continuous, but also a sheet material in which respective layers are discontinuous, for example, a sheet material formed by preparing the substrate, pearl layer, colored layer and clear layer separately and bonding them to one another in order. In general, a sheet material in which respective layers are continuous is preferred because the operation efficiency is high, the preparation steps are simple and a uniform pearl-like tint can easily be obtained.

This invention will now be described in detail by reference to the following Examples that by no means limit the scope of this invention. In these Examples, all percentages and parts are by weight.

EXAMPLE 1

A solution comprising 20% of a polyurethane elastomer (I) synthesized from polyethylene adipate glycol, diphenylmethane-4,4'-diisocyanate and ethylene glycol, 5% of a black pigment (carbon black) and 75% of dimethylformamide was impregnated in a non-woven fabric of nylon fibers, and the above solution was coated on the impregnated non-woven fabric in an amount of 110 g/m$^2$ as the solid. Then, the coated non-woven fabric was immersed for 30 minutes in an aqueous solution containing 50% of dimethylformamide, which was maintained at 50°C., to thereby effect coagulation. Then, the solvent was removed and the fabric was dried to obtain a porous substrate.

A solution comprising 6% of the same polyurethane elastomer (I) as mentioned above, 5% of a golden brown pearl pigment (Iriodin DY-Ti 100 manufactured by Merck & Co.), 10% of dimethylformamide, 49% of tetrahydrofuran and 30% of cyclohexanone was coated on the above porous substrate, so that the coating had a thickness of 2$\mu$ as the solid, and the coating was dried to form a pearl layer on the porous substrate. Then, a solution comprising 6% of the same polyurethane elastomer (I) as mentioned above, 4% of a brown complex salt dyestuff, (composed mainly of LANYL BROWN 3R manufactured by Sumitomo Chem. Inc. Co.), 10% of dimethylformamide, 49% of tetrahydrofuran and 31% of cyclohexanone was further coated so that the thickness of the coating was 2$\mu$ as the solid, and the coating was dried to form a colored layer on the pearl layer.

The so obtained porous sheet material (I) comprised a substrate having a thickness of 1.2mm and a density of 0.73 g/cm$^3$, a pearl layer having a thickness of 2$\mu$ and a colored layer having a thickness of 2$\mu$. In the pearl layer, the pearl pigment was contained in an amount of 83% based on the polymer, and in the colored layer, the dyestuff was contained in an amount of 67% based on the polymer. Despite the relatively dense color, the color of the sheet material (I) was the same color as the color used for the colored layer, and the color was very clear with a good pearl-like tint. The resulting porous sheet material was soft and excellent in flexural fatique strength. Accordingly, it was suitable as a leather-like sheet material.

COMPARATIVE EXAMPLE 1

The same polyurethane elastomer solution as used for formation of the pearl layer in Example 1 was mixed with the same polyurethane elastomer solution as used for formation of the colored layer in Example 1 at a mixing ratio of 1:1. The resulting mixed solution was coated on the same porous substrate as used in Example 1 so that the thickness of the coating was 4$\mu$ as the solid, and the coating was dried. The resulting porous sheet material (II) had a coating layer of a thickness of 4$\mu$, and the coating layer containing the pearl pigment in an amount of 42% based on the polymer and the dyestuff in an amount of 33% based on the polymer. This material (II) was considerably inferior in respect to the color clearness and the pearl-like tint, and the color of the material (II) was different from the brown color of the complex salt dyestuff and was slightly blackish. In short, the color of the resulting porous sheet material was different from the desired color.

COMPARATIVE EXAMPLE 2

A solution comprising 6% of the same polyurethane elastomer (I) as used in Example 1, 5% of a golden brown pearl pigment (Iriodin DY-Ti 100 manufactured by Merck & Co.), 4% of a brown complex salt dyestuff, (composed mainly of LANYL BROWN 3R manufacture by Sumitomo Chem. Inc. Co.), 10% of dimethylformamide, 49% of tetrahydrofuran and 26% of cyclohexanone was prepared. Two sheets of the same porous substrate as used in Example 1 were formed, and the above solution was coated thereon, so that the coatings had a thickness of 2 and 4$\mu$ as the solid, respectively, to form porous sheet materials (III) and (IV). Each of them was inferior in respect to the pearl-like tint and the color clearness. The tint was faint in the porous sheet material (III) and the color of the porous sheet material (IV) was a blackish brown. In each material, the desired color was not obtained.

EXAMPLE 2

Porous sheet materials (V) to (XIII) were prepared in the same manner as in Example 1 except that the amounts added of the pearl pigment and the dyestuff were changed as indicated below. The color clearness and the pearl-like tint of each sheet material were determined with the naked eye by a panel consisting of 30 persons, and properties as a leather-like sheet material were rated using a scale with a maximum of 10 points. Results obtained are shown in Table 1, in which a larger value indicates a better property.

Table 1

| Porous Sheet Material | Pigment Content (%) in Pearl Layer | Dyestuff Content (%) in Colored Layer | Pearl-like Tint | Color Clearness | Overall Judgement |
|---|---|---|---|---|---|
| V | 83 | 10 | 9 | 10 | 10 |
| VI | 83 | 50 | 10 | 10 | 10 |
| VII | 83 | 100 | 9 | 9 | 9 |
| VIII | 83 | 200 | 8 | 7 | 8 |
| IX (comparison) | 83 | 400 | 1 | 1 | 1* |
| X | 30 | 50 | 9 | 9 | 9 |
| XI | 200 | 50 | 10 | 10 | 10 |
| XII | 400 | 50 | 7 | 8 | 8 |
| XIII (comparison) | 600 | 50 | 3 | 5 | 2* |

*appearance and physical properties such that flexural fatigue strength was drastically degraded

EXAMPLE 3

A solution consisting of 12% of a polyurethane elastomer (II) synthesized from polycaprolactone glycol, diphenylmethane-4,4'-diisocyanate and 1,4-butane diol, 2% of polyvinyl chloride, 3% of a dark red pigment (composed mainly of N-165 RED manufactured by Dainichiseika Ind. Co.), and 83% of dimethylacetamide was coated on a polyethylene sheet in an amount of 65 g/m$^2$ as the solid, and the coated sheet was treated for 30 minutes with an aqueous solution containing 30% of dimethylformamide at 30°C. The coating was peeled from the polyethylene sheet, and removal of the solvent and drying were then conducted. The resulting porous sheet was laminated on a woven fabric of nylon to form a porous substrate. A mixture of 6% of the same polyurethane elastomer (II) as mentioned above, 2% of a red pigment, (composed mainly of Cadmium Type manufactured by Dainichiseika Ind. Co.), 10% of dimethylacetamide, 50% of tetrahydrofuran and 32% of cyclohexanone was sufficiently blended by means of an attritor, and the resulting liquid mixture was coated on the surface of the above porous substrate so that the thickness of the coating was 2$\mu$ as the solid. Then, the coated substrate was dried and pressed to form a kip grain pattern, whereby a hiding layer was formed on the porous substrate. Then, a solution consisting of 6% of the same polyurethane elastomer (II) as mentioned above, 6% of a red pearl pigment (IRIODIN R-Ti 100 manufactured by Merck & Co.), 15% of dimethylacetamide, 46% of tetrahydrofuran and 27% of cyclohexanone was further coated so that the thickness of the coating was 3$\mu$ as the solid, and then, the coating was dried to form a pearl layer. Then, a solution consisting of 7% of a polyurethane elastomer (III) synthesized from polyethylene glycol, diphenylmethane-4,4'-diisocyanate and ethylene glycol, 3% of a complex salt dyestuff (composed mainly of LANYL VIOLET manufactured by Sumitomo Chem. Ind. Co.) of a wine color, 15% of dimethylacetamide, 48% of tetrahydrofuran and 27% of cyclohexanone was coated so that the thickness of the coating was 2$\mu$ as a solid, and the coating was dried to form a colored layer. Finally, a solution consisting of 20% of the same polyurethane elastomer (III) as mentioned above, 3% of dimethylacetamide and 77% of tetrahydrofuran was coated so that the thickness of the coating was 20$\mu$ as the solid, and the coating was dried to form a clear layer. The so formed porous sheet material (XIV) comprised a substrate of a thickness of 1.0mm, a hiding layer of a thickness of 2$\mu$, a pearl layer of a thickness of 3$\mu$, a colored layer of a thickness of 2$\mu$, and a clear layer of a thickness of 20$\mu$. In the pearl layer, the content of the pearl pigment was 100% based on the polymer and the dyestuff content in the colored layer was 43% based on the polymer. In the so obtained porous sheet material, in spite of the dense color, the color matching could be performed very easily and the color uniformity was very clear. Further, the product had a very clear and excellent pearl-like tint, and hence, it has a very high commercial value.

EXAMPLE 4

A solution consisting of 15% of a polyurethane elastomer (IV) (having a nitrogen content of 4.2%) synthesized from polybutylene adipate glycol, diphenylmethane-4,4'-diisocyanate and 1,4-butane diol, 3% of carbon black and 82% of dimethylformamide was impregnated in a non-woven fabric of nylon fibers, and the same solution was coated on the impregnated non-woven fabric in an amount of 14 g/m$^2$ as the solid. Then, the fabric was immersed for 30 minutes in an aqueous solution containing 40% of dimethylformamide, which was maintained at 40°C., to effect coagulation. Then removal of the solvent and drying were conducted to form a porous substrate. A mixture consisting of 7% of the same polyurethane elastomer (IV) as mentioned above, 3% of carbon black, 15% of dimethylformamide, 45% of tetrahydrofuran and 30% of cyclohexanone was sufficiently blended by means of an attritor, and the resulting liquid mixture was coated on the surface of the above porous substrate so that the thickness of the coating was 2μ as the solid. Then, the coating was dried to form a colored layer. Then a solution consisting of 7% of the same polyurethane elastomer (IV) as mentioned above, 4% of a gray pearl pigment (Iriodin Ti 100 manufactured by Merck & Co.), 15% of dimethylformamide, 44% of tetrahydrofuran and 30% of cyclohexanone was further coated so that the thickness of the coating was 3μ, and the coating was dried to form a pearl layer.

The so obtained porous sheet material (XV) comprised a substrate of a thickness of 1.3mm, a colored layer of a thickness of 2μ and a pearl layer of a thickness of 3μ. In the colored layer, the content of carbon black (pigment) was 43% based on the polymer, and in the pearl layer, the content of the gray pearl pigment was 57% based on the polymer. The so obtained porous sheet material (XV) had a very excellent pearl-like tint and was suitable for the production of men's shoes, lady's shoes, sandals and interior decorative articles.

A solution consisting of 20% of the same polyurethane elastomer (IV) as mentioned above, 3% of dimethylformamide and 77% of tetrahydrofuran was coated on the above porous sheet material (XV) so that the thickness of the coating was 20μ as the solid, and the coating was dried to form a clear layer. The so obtained porous sheet material (XVI) had an enameled gloss and was very excellent in the pearl-like tint.

EXAMPLE 5

A solution consisting of 10% of the same polyurethane elastomer (IV) as used in Example 4, 1% of polyvinyl manufactured 3% of a brown pigment (Azo type manufacture by Dainichiseika Ind. Co.), and 86% of dimethylformamide was coated on a polyethylene sheet in an amount of 80 g/m² as the solid, and the coated sheet was treated for 30 minutes with an aqueous solution containing 40% of dimethylformamide, which waas maintained at 30°C. The treated coating was peeled from the polyethylene sheet, and removal of the solvent and drying were conducted. Then, the resulting sheet was laminated on a woven fabric of nylon to form a substrate. A solution consisting of 6% of a polyurethane elastomer (V) (having a nitrogen content of 6%) synthesized from polyethylene glycol, diphenylmethane-4,4'-diisocyanate and ethylene glycol, 4% of brown complex salt dyestuff, (composed mainly of LANYL BROWN manufactured by Sumitomo Chem. Inc. Co.), 17% of dimethylformamide, 45% of tetrahydrofuran and 28% of cyclohexanone was coated on the above substrate so that the thickness of the coating was 2μ as the solid, and the coating was dried to form a colored layer. Then, a solution consisting of 7% of the same polyurethane elastomer (IV) was used for formation of the substrate, 1% of polyvinyl chloride, 7% of a golden brown pearl pigment (IRIODIN DY-Ti 100 manufactured by Merck & Co.) 1% of a brown complex salt dyestuff (composed mainly of LANYL BROWN manufactured by Sumitomo Chem. Ind. Co.), 15% of dimethylformamide, 42% of tetrahydrofuran and 27% of cyclohexanone was coated so that the thickness of the coating was 3μ as the solid, and the coating was dried and a kid grain pattern was embossed thereon to form a pearl layer. Then, a solution consisting of 20% of the same polyurethane elastomer (V) as mentioned above, 3% of dimethylformamide and 77% of tetrahydrofuran was further coated so that the thickness of the coating was 20μ as the solid, and the coating was dried to form a clear layer, The resulting porous sheet material (XVII) comprised a colored layer of a thickness of 2μ, a pearl layer of a thickness of 3μ and a clear layer of a thickness of 20μ. In the colored layer, the dyestuff content was 67% based on the polymer, and in the pearl layer, the contents of the pigment and the dyestuff were 88 and 13% respectively, based on the polymer. This porous sheet material was very excellent in the pearl-like tint and gloss and was very suitable for the production of lady's boots.

EXAMPLE 6

Porous sheet materials (XVIII) to (XXII) were prepared in the same manner as in Example 1 except that the pearl layer and colored layer were changed in the thickness as indicated below. The pearl-like tint and the color clearness were evaluated with the naked eye in respect to each product, and the touch was evaluated with the hand. The flexural fatique strength was determined according to JIS K-6505 using a Flexo flexural fatique tester. Properties as the leather-like sheet material were judged employing a rating with a maximum of 10 points. Results are shown in Table 2.

Table 2

| Porous Sheet Material | Thickness (μ) of Pearl Layer | Thickness (μ) of Colored Layer | Pearl-like tint | Color Clearness | Flexural Fatigue Strength × 10⁴ | Touch | Overall Judgement |
|---|---|---|---|---|---|---|---|
| XVIII | 2 | 2 | 2 | 10 | 105 | 10 | 10 |
| XIX | 2 | 6 | 9 | 9 | 90 | 8 | 9 |
| XX (comparison) | 2 | 20 | 2 | 2 | 20 | 2 | 2 |
| XXI | 6 | 2 | 9 | 9 | 80 | 9 | 9 |
| XXII (comparison) | 20 | 2 | 4 | 5 | 25 | 2 | 3 |

What we claim is:

1. A leather-like sheet material having a pearl-like tint, which comprises (1) a substrate comprising a fibrous mat and a porous coating layer of a polymer composed mainly of a polyurethane elastomer, (2) a pearl layer having a thickness of 0.2 to 10μ and comprising a polymer composed mainly of a polyurethane elastomer and 3 to 500% by weight, based on the polymer, of a pearl pigment, and (3) a colored layer having a thickness of 0.1 to 10μ and comprising a polymer composed mainly of a polyurethane elastomer and 1 to 300% by weight, based on the polymer, of a dyestuff and/or 1 to 600% by weight, based on the polymer, of a pigment.

2. A leather-like sheet material as set forth in claim 1 wherein the pearl layer is overlayed by the colored layer on the substrate and the colored layer has a thickness of 0.1 to 10μ and comprises a polymer composed mainly of a polyurethane elastomer and 1 to 300% by weight, based on the polymer, of a dyestuff.

3. A leather-like sheet material as set forth in claim 2 wherein a clear layer is further overlayer upon the colored layer, said clear layer having a thickness of 0.1 to 100μ and comprising a polymer composed mainly of a transparent polyurethane elastomer.

4. A leather-like sheet material as set forth in claim 2 wherein a hiding layer is disposed between the substrate and said pearl layer, said hiding layer having a thickness of 0.1 to 10μ and comprising a polymer composed mainly of a polyurethane electromer and 1 to 600% by weight, based on the polymer, of a pigment.

5. A leather-like sheet material as set forth in claim 4 wherein a clear layer is further overlayed upon said colored layer, said clear layer having a thickness of 0.1 to 100μ and comprising a polymer composed mainly of a transparent polyurethane elastomer.

6. A leather-like sheet material as set forth in claim 1 wherein the colored layer is overlayed by the pearl layer on the substrate.

7. A leather-like sheet material as set forth in claim 6 wherein a clear layer is further overlayed upon the pearl layer, said clear layer having a thickness of 0.1 to 100μ and comprising a polymer composed mainly of a transparent polyurethane elastomer.

8. A leather-like sheet material as set forth in claim 1 wherein the pearl pigment in the pearl layer is a pigment having a particle size of 1 to 70μ formed by coating mica with titanium oxide.

9. A leather-like sheet material as set forth in claim 2 wherein the polyurethane elastomer of the colored layer is synthesized by using polyethylene glycol as one component.

10. A process for the preparation of leather-like sheet materials having a pearl-like tint in which color matching can be performed very easily, said process comprising laying a pearl layer having a thickness of 0.2 to 10μ and comprising a polymer composed mainly of a polyurethane elastomer and 3 to 500% by weight, based on the polymer, of a pearl pigment, upon a substrate comprising a fibrous mat and a porous coating layer, and then overlaying upon said pearl layer, a colored layer having a thickness of 0.1 to 10μ and comprising a polymer composed mainly of a polyurethane elastomer and 1 to 300% by weight, based on the polymer, of a dyestuff.

11. A process as set forth in claim 10 wherein said colored layer is further overlayed by a clear layer having a thickness of 0.1 to 100μ and comprising a polymer composed mainly of a transparent polyurethane elastomer.

12. A process as set forth in claim 10 wherein a hiding layer is disposed between the substrate and said pearl layer, said hiding layer having a thickness of 0.1 to 10μ and comprising a polymer composed mainly of a polyurethane elastomer and 1 to 600% by weight, based on the polymer, of a pigment.

* * * * *